United States Patent [19]

Sakoda

[11] Patent Number: 4,609,800

[45] Date of Patent: Sep. 2, 1986

[54] MICROWAVE OVEN DOOR STRUCTURE

[75] Inventor: Yasuhiro Sakoda, Wakayama, Japan

[73] Assignee: Sharp Kabushiki Kaisha, Osaka, Japan

[21] Appl. No.: 731,723

[22] Filed: May 8, 1985

[30] Foreign Application Priority Data

Jun. 15, 1984 [JP] Japan ..... 59-89598[U]

[51] Int. Cl.[4] ..... H05B 6/64

[52] U.S. Cl. ..... 219/10.55 D; 219/10.55 R; 126/200

[58] Field of Search ..... 126/190, 200, 196; 219/10.55 R, 10.55 D, 10.55 F

[56] References Cited

U.S. PATENT DOCUMENTS

| | | | |
|---|---|---|---|
| 4,215,258 | 7/1980 | Nelson | 126/200 |
| 4,264,800 | 4/1981 | Jahnke et al. | 126/200 |
| 4,292,488 | 9/1981 | Birk | 126/200 |

*Primary Examiner*—James C. Yeung

*Attorney, Agent, or Firm*—Birch, Stewart, Kolasch & Birch

[57] ABSTRACT

A unique structure of a door for a microwave oven having integrally assembled bent-members comprising: a choke cavity provided with a sectional slit along the external periphery of the door body for the prevention of microwaves from leakage to the outside; a metal contact part held in contact with part of the peripheral edge of the opening of the oven; and a punching portion securely covering the front surface of the opening of the oven.

2 Claims, 3 Drawing Figures

MICROWAVE OVEN DOOR STRUCTURE

BACKGROUND OF THE INVENTION

The present invention relates to the structure of the door of a microwave oven.

The conventional structure of the door of a microwave oven is shown in FIG. 2. Typically, a microwave oven is installed by correctly aligning the edge of the opening of the housing sheet 1 with the externally bent edge portion of the opening of the cooking chamber 3, followed by setting the magnetron 2 which is installed in the space between the upper surface of the cooking chamber 3 and the housing sheet 1 for radiating microwaves into the cooking chamber 3. A heat-resistant plate 4 accommodating food 5 is installed on the bottom of the cooking chamber 3, and a door A is installed in the front opening of the cooking chamber 3, i.e., oven B, so that the door A can be opened and closed freely.

The structure of the contact part of the door A and the front portion of the cooking chamber 3 is described below. As shown in FIG. 3, the door unit 7 has an edge yoke which is sectionally free of a slit, while the fixing plate 8 is secured to the inner edge yoke. A shielding plate 11 is sandwiched between the fixing plate 8 and the inner door plate 10 by securely being fastened with screw 12. The inner transparent material 9 adjacent to the shielding plate 11 is sandwiched by the edge yoke of the inner door plate 10. The choke cover 13 is placed between the edge of the external angle of the inner door plate 10 and the other edge of the external angle of the door body 7, thus forming an empty choke cavity 6 along the external edge portion of the door unit, while the choke cavity 6 is tightly held against the edge of the opening of the cooking chamber 3 to prevent microwaves from leaking outside. The periphery of the door body 7 is provided with the holder plate 15 of the front screen which is tightly pressed against the front surface of the door body 7, while the holder plate 15 is fastened with screw 17. Using the edge yoke, the periphery of the holder plate 15 is covered so that the head of screw 17 can be concealed. As is clear from the structure mentioned above, a conventional choke cavity provided in the external periphery of the door body needs to use a variety of parts, including a holder plate 15, edge yoke 16, inner door plate 10, fixing plate 8, screws 12 and 17, etc., all of which are fastened with screws before eventually being assembled into a complete door unit. As a result, the door unit requires a number of parts, thus unavoidably causing the assembly process to become complex, lowering productivity and raising costs.

OBJECTS AND SUMMARY OF THE INVENTION

In the light of the above disadvantages still present in the production of a conventional door assembly, the present invention aims at providing a unique door assembly for microwave ovens by effectively reducing the number of component parts to achieve a simplified door structure, improved productivity and reduced production costs. Typically, the preferred embodiment of the present invention provides a microwave oven with unique door components by integrating the punching element, the metal contact element, and the choke cavity into a single unit. In particular, the preferred embodiment provides an integrated door assembly supported in front of the microwave oven comprising a choke cavity sectionally provided with a slit effective for the prevention of microwaves from leakage through the external periphery of the door body; a metal contact part held in contact with part of the peripheral edge of the opening of the microwave oven; and a punching portion covering the front surface of the opening, all of which are integrally connected to each other in a bent shape.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENT

Figure 3:
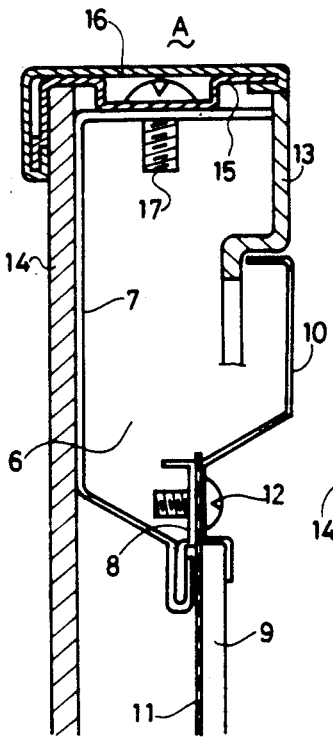
FIG. 3 is an enlarged sectional view of the door structure of a conventional microwave oven.
Figure 1:
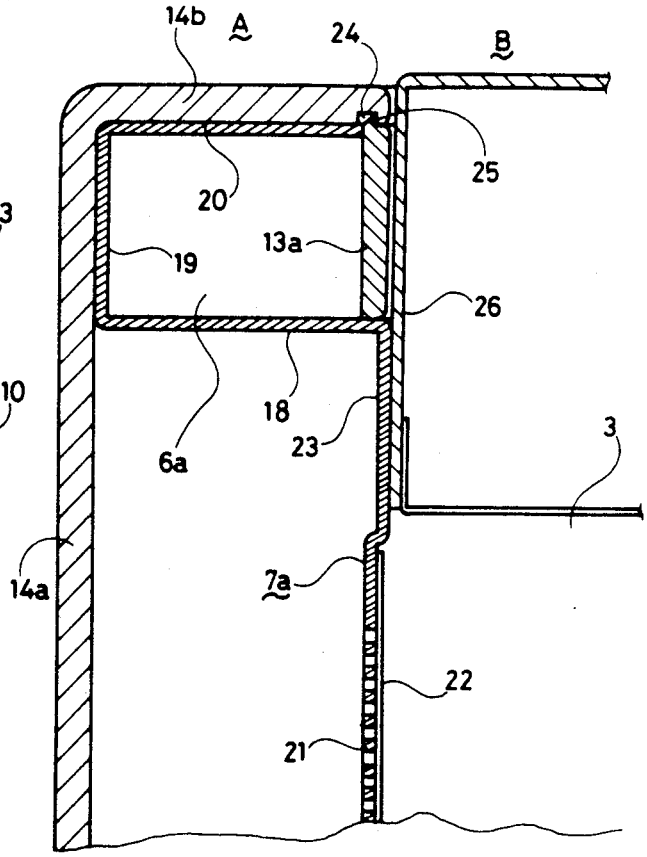
FIG. 1 is an enlarged sectional view of the door assembly structure reflecting the preferred embodiment of the present invention.
Figure 2:
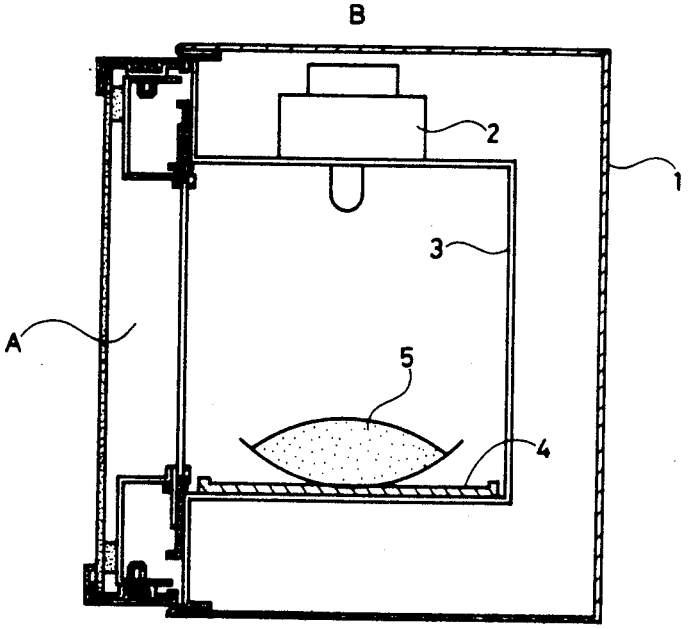
FIG. 2 is a sectional view of a conventional microwave oven.

Referring now to the attached drawings, the preferred embodiment of the present invention is described below. Door A secured to the opening part of the front surface of the oven B forms a choke cavity provided with a shaped slit sectionally surrounded by the bent-sides 18, 19, and 20, in the external periphery part 21 that faces the metal contact part 23 adjacent to the front part 26 of the oven B, where the punching part 21 is formed in connection with the choke cavity **6*a* in a position close to the center of the door. The front screen 14*a* is secured to the front part of the door body 7*a* so that the front screen 14*a* can surround the external periphery of the door body 7*a*. The internal slit 24 is provided in a position matching the edge surface of the bent side 20 of the door body 7*a* inside of the peripheral portion 14*b* of the front screen 14*a*. The choke cover 13*a* closes the opening of the choke cavity 6*a* by inserting the projection 25 into the inner slit 24, and then the front screen 14 is securely coupled to the door body 7*a*, thus making up the door. The door body 7*a* and the front screen 14*a* can be securely assembled merely by inserting the choke cover 13*a* into the rear inner periphery of the front screen 14*a*, and, as a result, the door assembly operation can be accomplished very easily, and yet, since the front screen 14*a* is integrally formed along the external periphery of the choke cavity 6*a*, it completely conceals the screws used for assembly, thus providing a pleasing external appearance. The transparent film 22** is provided in a position adjacent to the punching part so that it correctly faces the opening of the microwave oven.

As described above, the preferred embodiment of the present invention provides a slit-formed choke cavity **6*a* disposed along the external periphery of the door body 7*a*, while the front screen 14*a* can be easily assembled with the door body 7*a* merely by coupling the projection 25 on the tip portion of the choke cover 13*a* into the inner slit of the peripheral edge of the front screen 14*b* surrounding the external periphery of the choke cavity 6*a*. Likewise, the integrated configuration of the metal contact part 23 and the choke cavity 6*a*** are totally free from seam, thus ensuring complete coverage of the opening of the cooking chamber thus eliminating even the slightest amount of microwave leakage to the outside. The preferred embodiment of the present invention provides the door structure thus described, in which the choke cavity, metal contact part and the punching part are integrally connected to each other by effectively using the door component members. Such door assembly structure significantly reduces the number of parts in comparison to the conventional door structure where the internal door plate, shielding members and the door body are separate. Accordingly, the preferred embodiment of the present invention provides a greatly simplified door structure which reduces total production costs and results in higher productivity.

What is claimed is:

1. A microwave oven door structure for closing the opening of an oven chamber which comprises a door wall defining a door cavity, said door wall having an internal slit for preventing microwave leakage to the environment, a plurality of integrally assembled, bent-shaped side walls defining a choke cavity disposed within said door cavity, one of the side walls of said choke cavity positioned adjacent said internal slit, a choke cover provided with a projecting element, said choke cover closing said choke cavity with the projecting element thereof extending into said internal slit, a metal contact element extending from one of the side walls of said choke cavity and held in contact with part of a peripheral edge of the opening of the oven, and a punching portion securely covering the front surface of the opening of the oven.

2. The microwave oven door structure of claim 1 wherein the walls of the choke cavity have a U-shaped configuration with the opening thereof facing toward the oven.

* * * * *